US007503309B2

(12) United States Patent
Tanimura et al.

(10) Patent No.: US 7,503,309 B2
(45) Date of Patent: Mar. 17, 2009

(54) THROTTLE CONTROL APPARATUS

(75) Inventors: Hiroshi Tanimura, Kariya (JP); Hiroyuki Kado, Kariya (JP); Hiroshi Asanuma, Obu (JP)

(73) Assignees: Denso Corporation, Kariya (JP); Aisan Kogyo Kabushiki Kaisha, Obu (JP)

( * ) Notice: Subject to any disclaimer, the term of this patent is extended or adjusted under 35 U.S.C. 154(b) by 15 days.

(21) Appl. No.: 11/798,546

(22) Filed: May 15, 2007

(65) Prior Publication Data

US 2008/0011269 A1 Jan. 17, 2008

(30) Foreign Application Priority Data

Jul. 14, 2006 (JP) ..... 2006-194014

(51) Int. Cl.
*F02D 11/10* (2006.01)
*F02D 11/00* (2006.01)

(52) U.S. Cl. ..... 123/396

(58) Field of Classification Search ..... 123/337, 123/399, 396, 397, 398, 400, 403; 701/114
See application file for complete search history.

(56) References Cited

U.S. PATENT DOCUMENTS 4,951,772 A * 8/1990 Peter et al. ..... 180/197
5,263,448 A * 11/1993 Bluhm et al. ..... 123/396
5,297,521 A * 3/1994 Sasaki et al. ..... 123/396
6,488,009 B2 12/2002 Sakurai et al.
6,640,776 B2 11/2003 Torii
6,834,639 B2 12/2004 Torii
6,863,259 B2 3/2005 Torii et al.
6,962,325 B2 11/2005 Torii et al.
6,986,336 B2 1/2006 Tanimura et al.
7,051,707 B2 5/2006 Tanimura et al.
7,063,067 B2 * 6/2006 Kado et al. ..... 123/399
7,207,313 B2 4/2007 Torii
7,261,083 B2 * 8/2007 Kondo ..... 123/399
2004/0084016 A1 * 5/2004 Torii et al. ..... 123/399
2004/0173184 A1 * 9/2004 Tanimura et al. ..... 123/399
2005/0126536 A1 * 6/2005 Torii et al. ..... 123/399
2006/0005809 A1 * 1/2006 Kado et al. ..... 123/399
2006/0231072 A1 * 10/2006 Saito et al. ..... 123/396
2007/0056559 A1 * 3/2007 Kondo ..... 123/399
2007/0068581 A1 * 3/2007 Kondo ..... 137/554

OTHER PUBLICATIONS

German Office Action, dated Aug. 12, 2008, issued in corresponding German Appln. No. 10 2007 000 346.5-13 with English translation.

* cited by examiner

*Primary Examiner*—Mahmoud Gimie
(74) *Attorney, Agent, or Firm*—Nixon & Vanderhye PC

(57) ABSTRACT

A throttle control apparatus has a torsional coil spring that is associated with the throttle body and the rotator to bias throttle valve to a predetermined intermediate angle between a full open angle and a full close angle. An actuator rotates the rotator against a biasing force of the torsional coil spring. The torsional coil spring has a first and a second loading portions that apply biasing forces to the rotator to bias the throttle valve from the full open angle or from the full close angle toward the intermediate angle. The rotator is provided with a spring force receiving portion that receives both the biasing forces applied by the first and second loading portions so that the first and second loading portions sandwich the spring force receiving portion therebetween.

18 Claims, 7 Drawing Sheets

THROTTLE CONTROL APPARATUS

CROSS REFERENCE TO RELATED APPLICATION

This application is based upon and claims the benefit of priority of Japanese Patent Application No. 2006-194014 filed on Jul. 14, 2006, the content of which is incorporated herein by reference.

FIELD OF THE INVENTION

The present invention relates to a throttle control apparatus in which an electric power supply to a motor is variably controlled to perform an opening/closing operation of a valve, and especially relates to the throttle control apparatus in which a spring returns the valve to a predetermined intermediate angle when the electric power supply to the motor is stopped.

BACKGROUND OF THE INVENTION

Conventionally, a throttle control apparatus in which a motor control unit (valve angle control unit) variably controls an electric power supplied to an electric motor to perform an opening/closing operation of a throttle valve that is rotatably installed in a housing. As an example of the throttle control apparatus, an air intake control apparatus for internal combustion engine is known, in which an electric motor rotationally actuates a valve body of an airflow rate control valve within a predetermined valve angle control range from a full close angle to a full open angle, to variably regulate a quantity of intake air supplied to combustion chambers of the internal combustion engine.

As shown in FIGS. 5-9B, the air intake control apparatus, which actuates the valve body (throttle valve) 101 of the airflow rate control valve to open and close an intake passage, is provided with an actuator that rotationally actuates the throttle valve 101 toward the full open angle and toward the full close angle from a predetermined intermediate angle, and a torsional coil spring 105 that biases the throttle valve 101 from the full open angle or from the full close angle to the intermediate angle. The actuator includes an electric motor 104, a power transmission mechanism that transmits a rotation of a motor shaft 111 of the electric motor 104 to a valve shaft 113 of the throttle valve 101; and a housing 106 that houses the torsional coil spring 105 and the power transmission mechanism therein. The housing 106 is integrally formed with a wall of a cylindrical portion 103 of a throttle body 102 that is opened and closed by the throttle valve 101. The power transmission mechanism includes a pinion gear 107, an intermediate reduction gear 108 and a valve gear 109.

The torsional coil spring 105 includes a return spring 141, which biases the throttle valve 101 from the full open angle to the intermediate angle, and an opener spring 142, which biases the throttle valve 101 from the full close angle to the intermediate angle, to keep the throttle valve 101 in a default intermediate angle at which the throttle valve 101 is slightly opened from the full close angle, to enable a fallback travel (limp home travel) of a vehicle in such a case that an electric power supply to the electric motor 104 is stopped due to any cause.

In this throttle control apparatus, the return spring 141 spirally surrounds a circumference of a cylindrical spring guide 125 of the housing 106 to exert a torsional spring force on the valve gear 109 to rotate the throttle valve 101 from the full open angle to the intermediate angle. The opener spring 142 spirally surrounds a circumference of a cylindrical spring guide 135 of the valve gear 109 to exert a torsional spring force on the valve gear 109 to rotate the throttle valve 101 from the full close angle to the intermediate angle.

In the throttle control apparatus, the return spring 141 and the opener spring 142 can be integrated in one torsional coil spring 105 as shown in FIG. 7, to reduce the number of parts, to simplify a construction, and to decrease a manufacturing cost of the throttle control apparatus. In the torsional coil spring 105, a connection portion of the return spring 141 and the opener spring 142 is bent in a generally U-shape to serve as a U-shaped hook 143. The torsional coil spring 105 is wound in one rotational direction on one side of the U-shaped hook 143, and is wound in the other rotational direction on the other side of the U-shaped hook 143, to provide the return spring 141 and the opener spring 142.

The housing 106 is provided with a first spring end support 151 that supports a first spring end portion (valve-side spring end portion) 144 of the torsional coil spring 105. The valve gear 109 is provided with a second spring end support 152 that supports a second spring end portion (gear-side spring end portion) 145 of the torsional coil spring 105. The U-shaped hook 143 is associated with a C-shaped support 156 of the valve gear 109 to go into an engagement with the C-shaped support 156 and to come out of the engagement.

In the throttle control apparatus disclosed, for example, in JP-2004-301118-A and its counterparts U.S. Pat. Nos. 6,986,336, 7,051,707, EP-1455069-A2, EP-1598538-A2 (which are referred to as Patent document 1 hereafter), the above-mentioned torsional coil spring 105, in which the return spring 141 and the opener spring 142 are integrated, has a coil configuration in which a center axis of the torsional coil spring 105 is previously decentered (offset) in its natural state in a direction opposite to an elastic deformation occurring in a radial direction when the torsional coil spring 105 is installed so that the first spring end portion 144 is supported by the first spring end support 151 of the housing 106 and the second spring end portion 145 is supported by the second spring end support 152 of the valve gear 109. Further, as shown in FIG. 8, both end hooks of the opener spring 142 (i.e., the U-shaped hook 143 and the second spring end portion 145) are aligned with each other in a direction of a torsion axis of the torsional coil spring 105. Thus, a frictional torque caused by a friction between the circumference of the cylindrical spring guide 135 of the valve gear 109 and an inner circumference of the opener spring 142 is reduced when electric power is supplied to the electric motor 104, so as to reduce a reaction torque acting on the electric motor 104.

In FIGS. 7, 9A, 9B, referential numeral 127 designates an intermediate angle stopper that is formed integrally with the housing 106, and reference numeral 129 designates an intermediate stopper member that is screwed in the intermediate angle stopper 127. Further, reference numeral 137 designates a full closure stopper portion that is provided in the valve gear 109, and reference numeral 139 designates a full closure stopper that is formed integrally with the housing 106.

In the valve gear 109 of the throttle control apparatus according to Patent document 1, the second spring end support 152, which supports the second spring end portion 145 of the opener spring 142, is provided separately from the C-shaped support 156, which goes into and comes out of the engagement with the U-shaped hook 143, at which the return spring 141 and the opener spring 142 are connected with each other.

When the throttle valve 101 is actuated to an angle between the full close angle and the intermediate angle as shown in FIG. 9A, the U-shaped hook 143 is moved apart from a support surface of the C-shaped support 156 of the valve gear 109. Thus, the torsional spring force acting on the C-shaped support 156 of the valve gear 109 is zero.

Contrarily, when the throttle valve 101 is actuated to an angle between the full open angle and the intermediate angle as shown in FIG. 9B, torsional spring forces generated by both the return spring 141 and the opener spring 142 are exerted on the support surface of the C-shaped support 156 of the valve gear 109. Thus, the C-shaped support 156 is subjected to a relatively large force. Therefore, it is necessary to form the C-shaped support 156 in a shape having a large thickness, a strengthening rib, etc., to provide the C-shaped support 156 with a rigidity enough to endure the relatively large force.

As described above, the valve gear 109 has the second spring end support 152 and the C-shaped support 156 that are separated from each other, so that the C-shaped support 156 must be provided with a rigidity enough to endure the relatively large force. This configuration of the second spring end support 152 and the C-shaped support 156 upsizes the valve gear 109, and increases manufacturing cost of the valve gear 109.

SUMMARY OF THE INVENTION

The present invention is achieved in view of the above-described issues, and has an object to provide a throttle control apparatus in which a spring force receiving portion, which has a relatively small rigidity, can receive a biasing force for returning a rotator, which is coupled to a throttle valve, to a predetermined intermediate angle. Another object of the present invention is to provide a throttle control apparatus in which a size of the rotator has a relatively small size.

The throttle control apparatus includes a throttle body, a rotator, a torsional coil spring and an actuator. The throttle body that defines a throttle duct therein. The rotator has a rotation axis and a throttle valve fixed to the rotation axis. The rotation axis is rotatably supported in the throttle duct so that the throttle valve rotates about the rotation axis between a full open angle to fully open the throttle duct and a full close angle to fully close the throttle duct. The torsional coil spring is arranged to be generally coaxial with the rotation axis. The torsional coil spring is associated with the throttle body and the rotator to bias throttle valve to a predetermined intermediate angle between the full open angle and the full close angle. The actuator rotationally actuates the rotator between the full open angle and the full close angle against a biasing force of the torsional coil spring.

The torsional coil spring has a first loading portion that applies a biasing force to the rotator to bias the throttle valve from the full open angle toward the intermediate angle, and a second loading portion that applies a biasing force to the rotator to bias the throttle valve from the full close angle to the intermediate angle. The rotator is provided with a spring force receiving portion that receives both the biasing forces applied by the first and second loading portions so that the first and second loading portions sandwich the spring force receiving portion therebetween.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

In a throttle control apparatus according to an example embodiment of the present invention, which is described in the following, a rigidity of a spring force receiving portion, which is formed integrally with a rotator, can be decreased by a configuration that both sides of the spring force receiving portion receive both a first biasing force to bias the rotator from a full open angle to an intermediate angle and a second biasing force to bias the rotator from a full close angle to the intermediate angle. Thus, a part of the first biasing force cancels the second biasing force to decrease a stress applied on the spring force receiving portion when the rotator is at an angle between the full open angle and the intermediate angle.

Further, in the throttle control apparatus according to the example embodiment, a size of the rotator can be downsized by integrating a first spring seat, which receives the first spring force, and a second spring seat, which receives the second spring force, in one spring force receiving portion.

[Construction of Throttle Control Apparatus]

Figure 1:
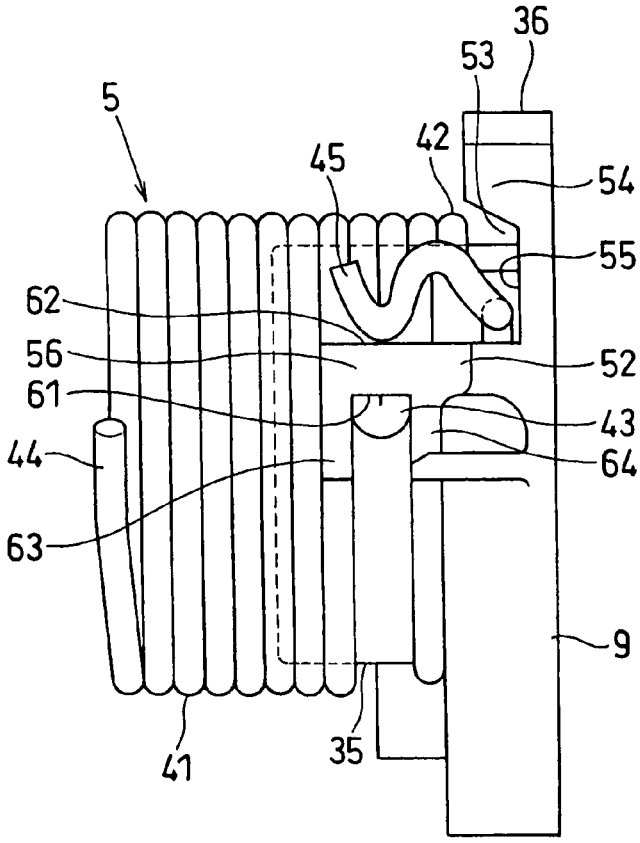
FIG. 1 is a side view showing a torsional coil spring and a valve gear of a throttle control apparatus according to an embodiment of the present invention.
Figure 3:
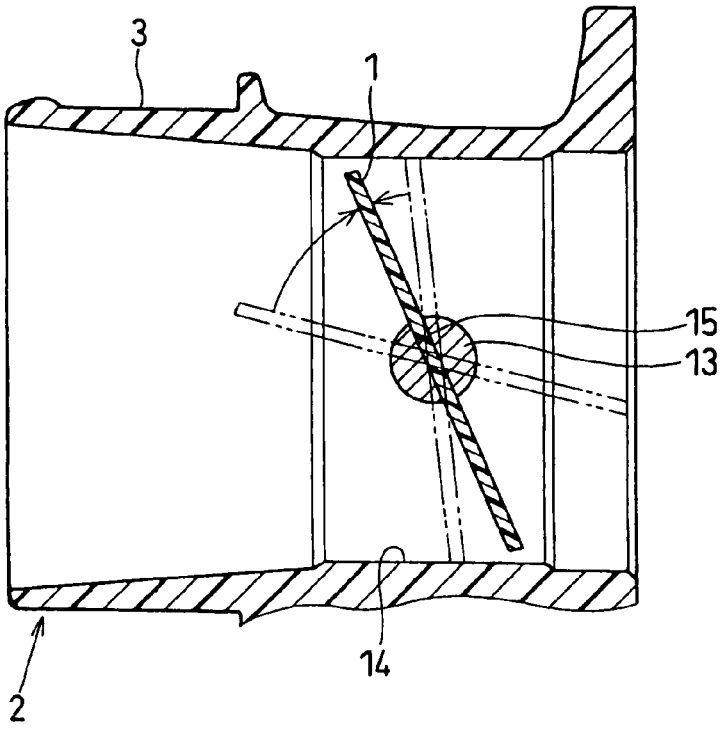
FIG. 3 is a cross-sectional view showing an intermediate angle of a throttle valve of the throttle control apparatus according to the embodiment.
Figure 2:
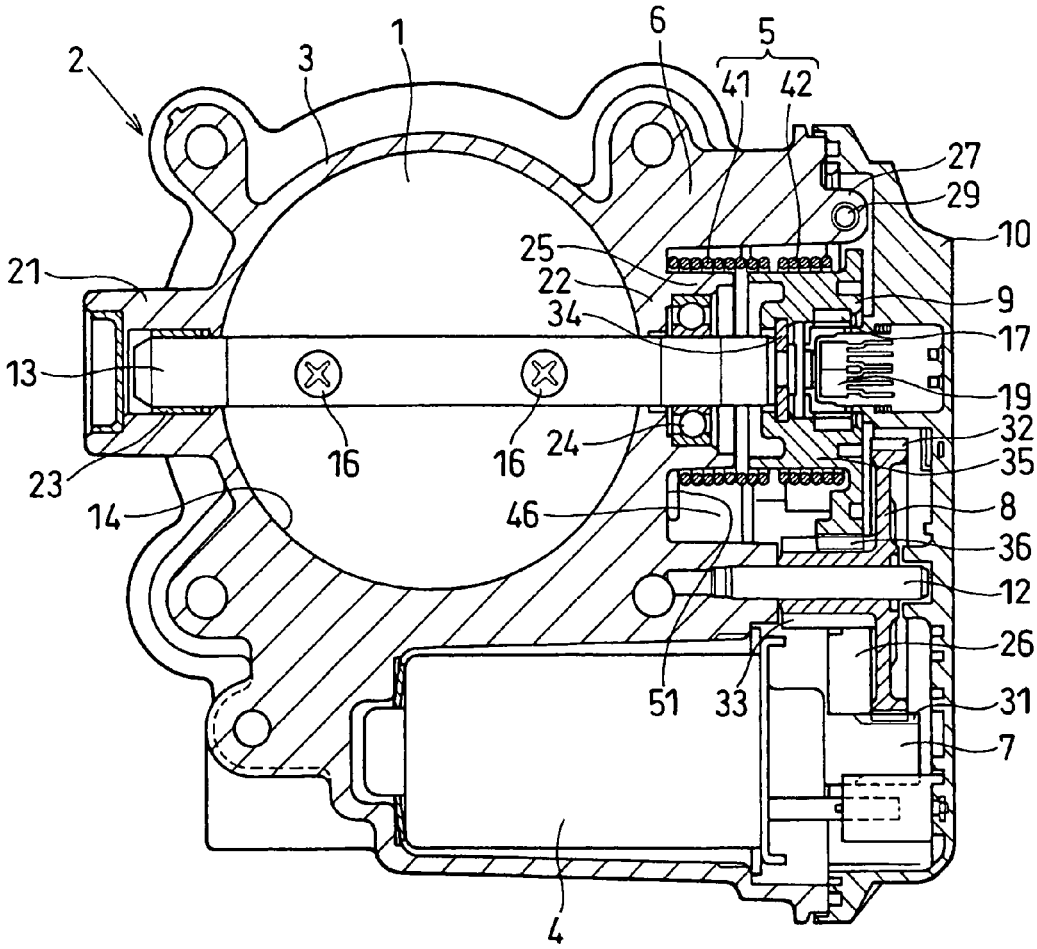
FIG. 2 is a cross-sectional view showing the throttle control apparatus according to the embodiment.

FIGS. 1-4B depict an air intake control apparatus (throttle control apparatus) according to the example embodiment. FIG. 1 illustrates a torsional coil spring 5 and a valve gear 9 that supports the torsional coil spring 5. FIG. 2 illustrates an entire construction of the air intake control apparatus. FIG. 3 illustrates a throttle valve 1 at an intermediate angle in a throttle bore 14 of the air intake control apparatus.

In the present embodiment, the air intake control apparatus, which corresponds to a throttle control apparatus according to the present invention, is incorporated in an air intake system of an internal combustion engine (which is referred to just as engine hereafter) that is installed in an engine room of a vehicle such as an automobile. Specifically, the air intake control apparatus is installed on the way of an intake pipe (intake duct) in which an intake air flows toward intake ports of combustion chambers in cylinders of the engine. The engine produces output power (e.g. output torque) by using thermal energy generated by burning air-fuel mixture in the combustion chamber.

The air intake control apparatus for internal combustion engine includes an airflow rate control valve (air intake control valve) and a valve actuator. The airflow rate control valve variably regulates a quantity of the intake air flowing from the air intake passage into the combustion chambers by changing a cross-sectional area of a passage of the intake pipe. The valve actuator actuates a valve body (which is referred to as a throttle valve hereafter) 1 of the airflow rate control valve between a full open angle and a full close angle. The air intake control apparatus controls a number of revolution and/or an output torque of the engine, by adjusting a throttle opening degree, which corresponds to a rotational angle of the throttle valve 1, in accordance with a degree to which an accelerator pedal of the vehicle is stepped down (quantity of accelerator operation), so as to variably regulate the quantity of the intake air that is supplied to the combustion chambers of the engine.

Figure 5:
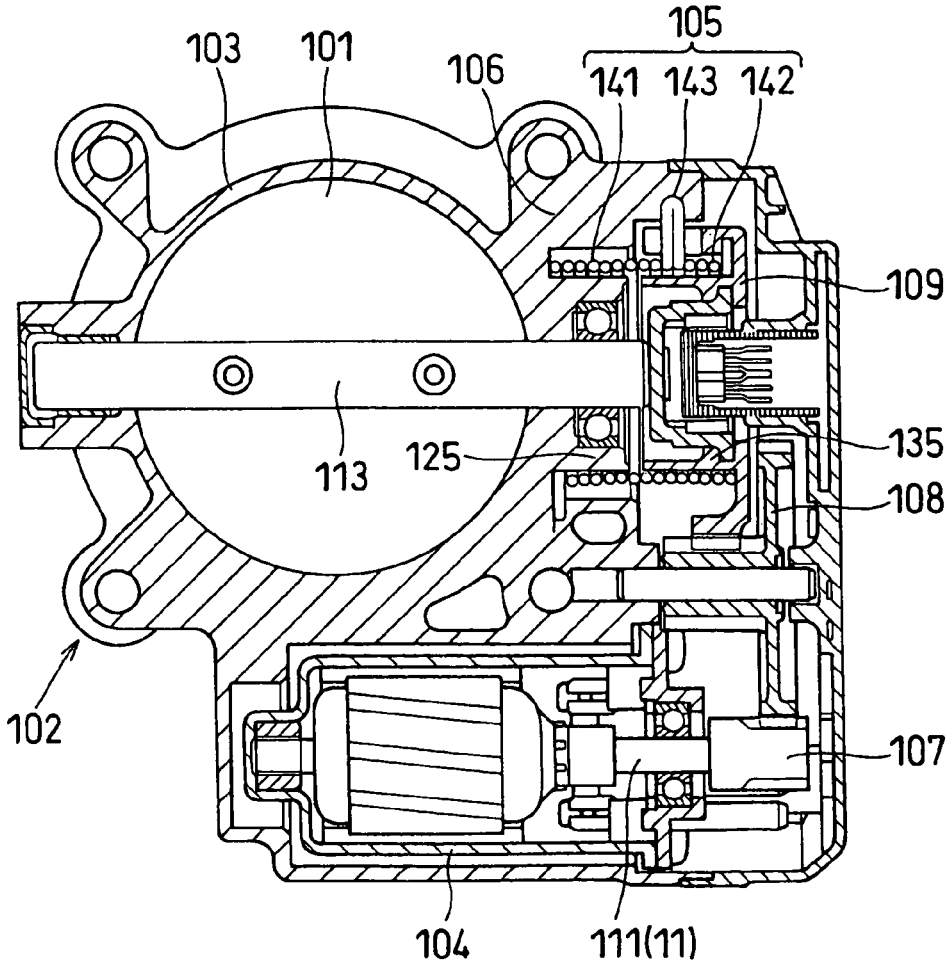
FIG. 5 PRIOR ART
FIG. 5 is a cross-sectional view showing a conventional throttle control apparatus.
Figure 6:
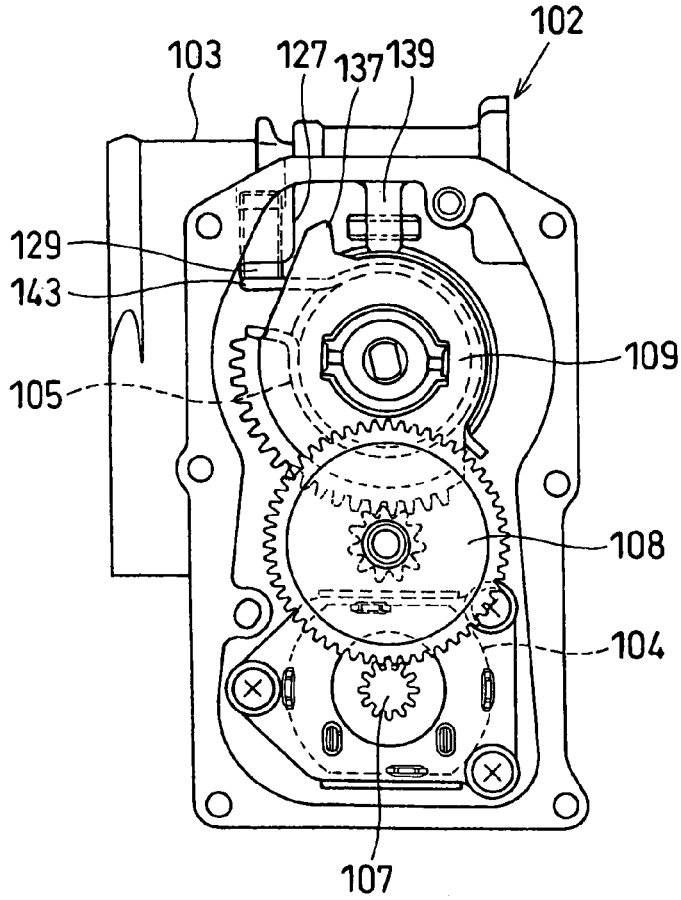
FIG. 6 PRIOR ART
FIG. 6 is a front view showing an actuator of the conventional throttle control apparatus.
Figure 8:
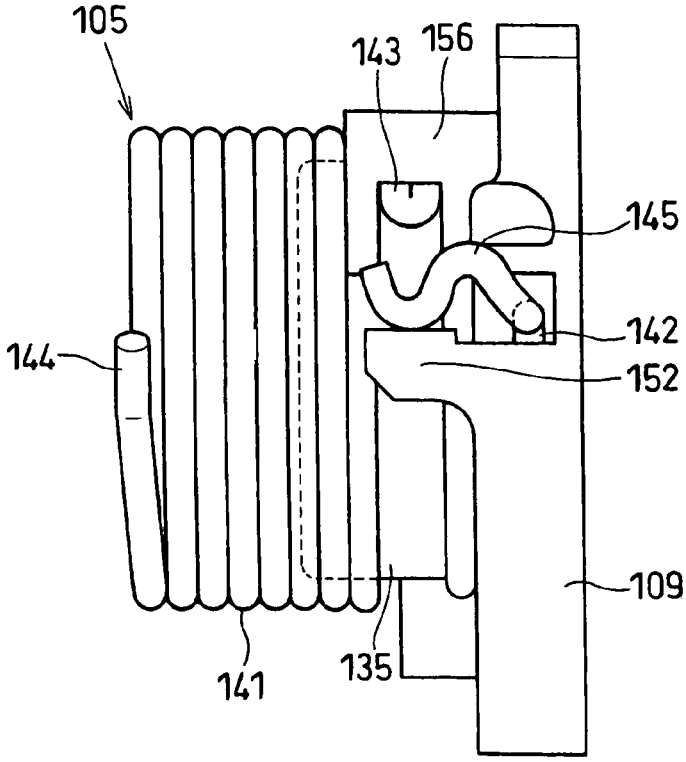
FIG. 8 PRIOR ART
FIG. 8 is a side view showing the valve gear and the torsional coil spring supported by the valve gear in the conventional throttle control apparatus.
Figure 7:
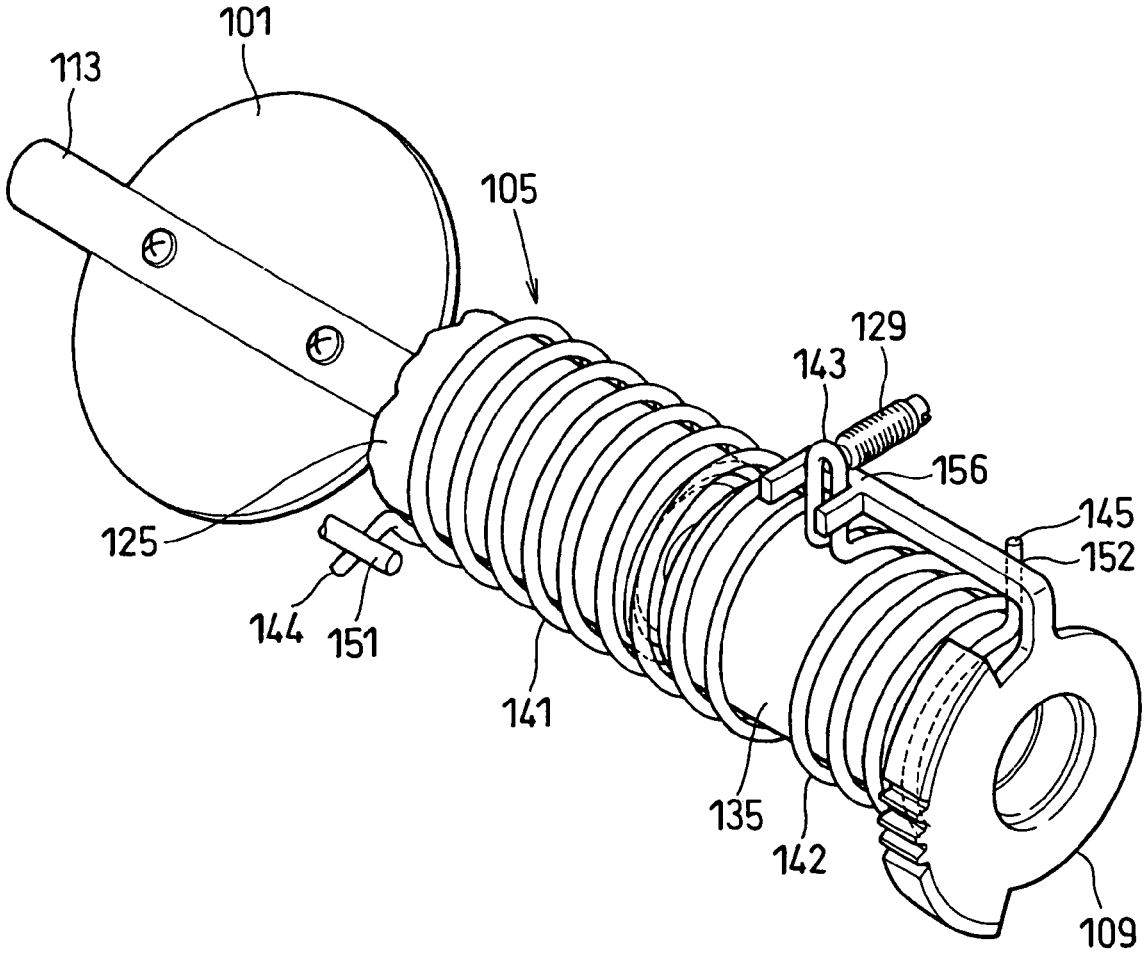
FIG. 7 PRIOR ART
FIG. 7 is a perspective view showing a torsional coil spring supported by the valve gear in the conventional throttle control apparatus.
Figure 9A:
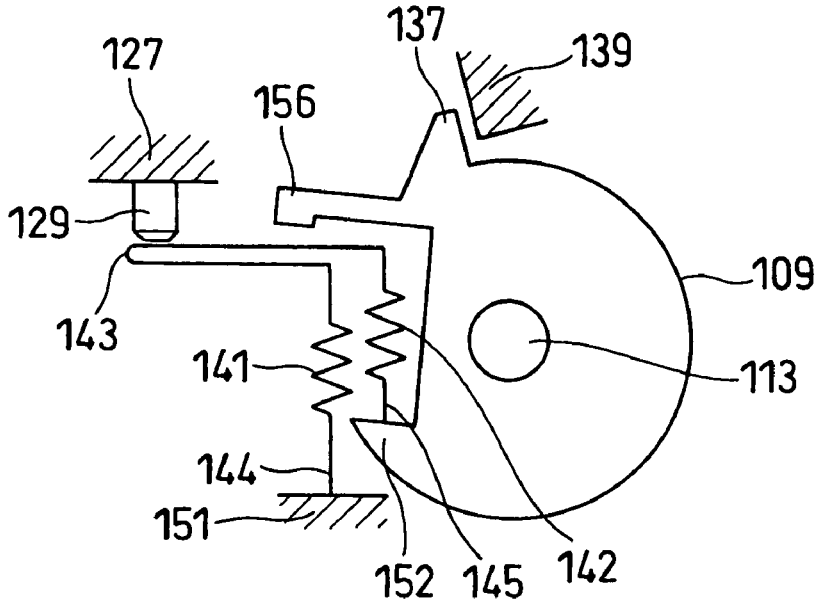
FIG. 9A PRIOR ART
FIGS. 9A, 9B are schematic diagrams showing spring load acting on the valve gear of the conventional throttle control apparatus.
Figure 9B:
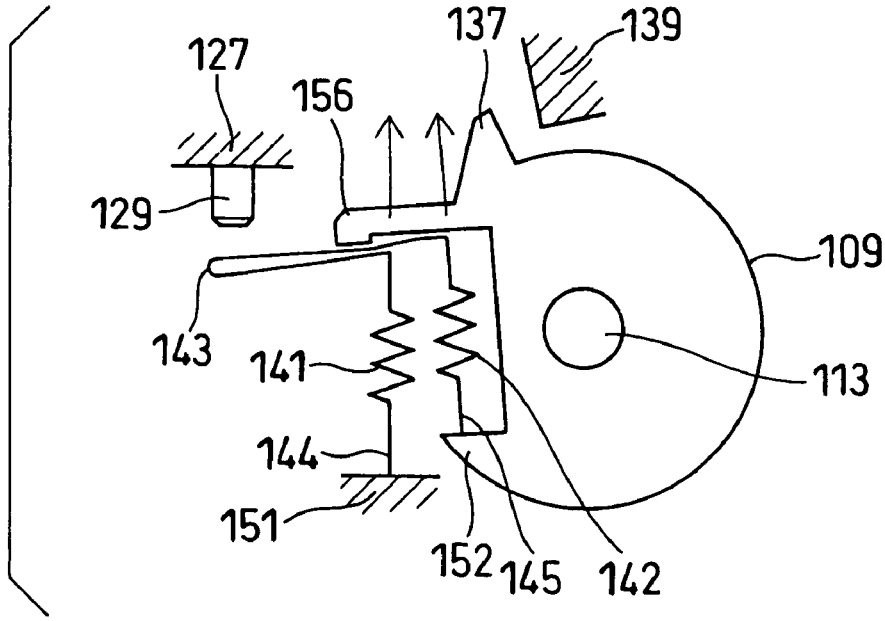
FIG. 9B PRIOR ART

The airflow rate control valve includes the throttle valve 1 and a throttle body 2. The throttle valve 1 has a disk-like shape and regulates the quantity of the intake air in accordance with the throttle opening degree (rotational angle of the throttle valve 1). The throttle valve 1 is rotatably installed in the throttle body 2 to open and close the intake pipe. The throttle body 2 has a cylindrical throttle wall portion (which is referred to just as a cylindrical portion) 3 in which a throttle bore having a round cross-sectional shape is formed. A housing 6 is formed integrally with an outside wall of the cylindrical portion 3. A motor shaft 11 of an electric motor 4 (refer to FIG. 5), an intermediate shaft 12, a valve shaft 13, and a torsional coil spring 5 that is spirally wound are installed in the housing 6. The motor shaft 11, the intermediate shaft 12 and the valve shaft 13 are arranged in parallel with each other. The intermediate shaft 12 serves as a shaft of an intermediate reduction gear 8, and a valve shaft 13 serves as a shaft of the throttle valve 1.

In the present embodiment, the throttle valve 1 is made of metallic material or resinous material. The throttle valve 1 is a butterfly valve that is installed in the throttle bore 14 to be rotatable with respect to the cylindrical portion 3 of the throttle body 2 so as to open and close the throttle bore 14. The throttle valve 1 moves in a valve angle control range between a full close angle and a full open angle to adjust the throttle opening degree (rotational angle of the throttle valve 1), to change an opening area of the throttle bore 14. Thus, the throttle valve 1 variably regulates the quantity of the intake air that is sucked into the combustion chambers in the cylinders of the engine.

The full close angle of the throttle valve 1 designates one of the throttle opening degree (rotational angle of the throttle valve 1) to minimize a clearance between the throttle valve 1 and a cylindrical portion 3 of the throttle body 2, that is, to minimize the quantity of the intake air flowing through the throttle bore 14. The full open angle of the throttle valve 1 designates another one of the throttle opening degree (rotational angle of the throttle valve 1) to maximize the clearance between the throttle valve 1 and a cylindrical portion 3 of the throttle body 2, that is, to maximize the quantity of the intake air flowing through the throttle bore 14. In the present embodiment, the throttle valve 1 is configured to variably control an electric power supply to the electric motor 4 in accordance with the degree to which the accelerator pedal of the vehicle is stepped down (quantity of accelerator operation) to adjust the throttle opening degree that corresponds to the rotational angle of the throttle valve 1.

The throttle valve 1 is inserted in a valve installation slit 15 that is formed in the valve shaft 13, and screw-fastened to the valve shaft 13 by screws 16. As such, the throttle valve 1 and the valve shaft 13 are integrated to rotate integrally. The valve shaft 13 is made of metallic material. The throttle valve 1 is supported by and fixed to the valve shaft 13. The valve shaft 13 is arranged on a rotation axis about which the throttle valve 1 rotates. For example, the valve shaft 13 is arranged to penetrate the throttle valve 1 in a diameter of the disk-like shape of the throttle valve 1. Both axial end portions of the valve shaft 13 are provided with sliding portions that are rotatably supported by bearing support portions 21, 22 formed in the cylindrical portion 3 of the throttle body 2 and in the housing 6.

The throttle body 2 is made of metallic material or resinous material. The throttle body 2 has the cylindrical portion 3 in which the throttle bore 14 is formed, and a housing 6 in which a gear installation chamber is formed. The throttle bore 14, which is formed in the cylindrical portion 3, is a part of the air intake passage (fluid path) that has a generally round cross-sectional shape and is communicated to the combustion chambers in the cylinders of the engine, to supply the intake air to the combustion chambers in the cylinders of the engine. An air inlet is formed at an upstream end of the cylindrical portion 3 to suck the intake air flown from an air cleaner via the intake duct. An air outlet is formed at a downstream end of the cylindrical portion 3 to supply the intake air to the intake ports of the engine via an intake manifold or a surge tank.

The bearing support portions 21, 22 are integrally formed in the cylindrical portion 3 on both end sides of an axial ends of the valve shaft 13, which is perpendicular to a direction of an average flow of the intake air through the throttle bore 14.

The sliding portion on a circumference of one axial end portion of the valve shaft 13 is rotatably supported by the bearing support portion 21 to interpose a bearing 23 between the valve shaft 13 and the bearing support portion 21. The bearing support portion 21 has a cylindrical portion in which a shaft supporting hole is formed to support the valve shaft 13 rotatably. The cylindrical portion of the bearing support portion 21 protrudes from the outside wall of the cylindrical portion 3 of the throttle body 2 to one side in the axial direction of the valve shaft 13.

The sliding portion on a circumference of the other axial end portion of the valve shaft 13 is rotatably supported by the bearing support portion 22 to interpose a ball bearing 24 between the valve shaft 13 and the bearing support portion 22. The bearing support portion 22 has a first cylindrical spring guide 25, in which has a shaft supporting hole is formed to support the valve shaft 13 rotatably. The first cylindrical spring guide 25 protrudes from the outside wall of the cylindrical portion 3 of the throttle body 2 to the other side in the axial direction of the valve shaft 13 (toward a sensor cover 10, for example). An outer circumference of the first cylindrical spring guide 25 of the housing 6 guides an inner circumference of the torsional coil spring 5.

The housing 6 is provided with the sensor cover 10 on which a throttle angle sensor, which is described hereafter, is supported and fixed. The sensor cover 10 is airtightly fitted to an opening-side end of the housing 6. A gear case (rotator installing room) 26, which includes a spring installing room, is provided in the housing 6. In the present embodiment, the gear case 26 is located between a bottom wall surface of housing 6 and a surface of the sensor cover 10, which faces the bottom wall surface of the housing 6. A first gear through a third gear (a motor gear 7, an intermediate reduction gear 8 and a valve gear 9), which form a power transmission mechanism (gear reduction mechanism), are rotatably installed in the gear case 26.

The housing 6 is further provided with an outer spring guide that surrounds an outer circumference of the torsional coil spring 5. An inner circumference of the outer spring guide of the housing 6 guides the outer circumference of the torsional coil spring 5. Further, a block-like shaped intermediate angle stopper 27 is formed integrally with a gear-side end portion of the outer cylindrical spring guide of the housing 6. An intermediate stopper member (opener screw for adjusting the intermediate angle) 29 is screwed in the intermediate angle stopper 27. The intermediate stopper member 29 keeps the throttle valve 1, the valve gear 9, etc. at the intermediate angle between the full close angle and the full open angle, in such cases that the electric power supply to the electric motor 4 is stopped or interrupted due to any cause, by using torsional spring force (torque) of the torsional coil spring 5.

As shown in FIG. 3, the intermediate angle of the throttle valve 1 is the throttle opening degree (rotational angle of the throttle valve 1) slightly opened from the full close angle, at which the air intake control apparatus can supply a quantity of the intake air for enabling at least a failback travel (limp home travel) of the vehicle. A construction for supporting the torsional coil spring 5 is described hereafter in detail.

A valve actuator includes the torsional coil spring 5, a motor actuator and an engine/motor control unit (which is referred to as an ECU hereafter). The torsional coil spring 5 biases the throttle valve 1 toward the intermediate angle from the full open angle and from the full close angle. The motor actuator actuates the throttle valve 1 from the intermediate angle toward the full open angle and toward the full close angle. The ECU variably controls the electric power supply to the motor actuator (especially the electric motor 4) to electrically adjust the throttle opening degree. As described above, the air intake control apparatus in the present embodiment constitutes an electrically controlled throttle control apparatus.

The motor actuator includes the electric motor 4, the power transmission mechanism (gear reduction mechanism in the present embodiment) and the housing 6. The electric motor 4 generates a rotational actuating force (actuating torque) in accordance with a magnitude of the electric power supply. The power transmission mechanism transmits a rotation of the motor shaft (output shaft) 11 of the electric motor 4 to the valve shaft 13. The torsional coil spring 5 and the power transmission mechanism are installed in the housing 6.

In the present embodiment, a direct current motor (DC motor), which is electrically controlled by the ECU), serves as the electric motor 4. The electric motor 4 is fixedly supported in a motor installing room in the housing 6. The electric motor 4 is electrically connected via a motor driving circuit, which is electrically controlled by the ECU, to a battery that is installed on the vehicle. The electric motor 4 is a DC motor having brushes, which includes a rotor (armature) that is integrated with the motor shaft 11, a stator (field) that is arranged to face an outer circumference of the rotor, etc. It is also possible to use a brushless DC motor, or an alternating current motor (AC motor) such as an induction motor and a synchronous motor as the electric motor 4, instead of the DC motor having brushes. It is also possible to use a rotary solenoid as a power source of the air intake control apparatus, instead of electric motor.

The gear reduction mechanism includes a plurality of gears (three gears in the present embodiment: the motor gear 7, the intermediate reduction gear 8 and the valve gear 9) that reduces a number of revolution of the motor shaft 11 of the electric motor 4 in two phases so that the gear reduction mechanism has a predetermined reduction gear ratio. The gear reduction mechanism serves as a power transmission mechanism that transmits the rotational actuating force (actuating torque) of the electric motor 4 to the throttle valve 1 via the valve shaft 13. These three gears 7-9 are rotatably installed in the housing 6.

The motor gear 7, which is a component of the gear reduction mechanism, is a first gear (pinion gear, first rotator) that is fixed to an outer circumference of the motor shaft 11 of the electric motor 4. The motor gear 7 is located at a most motor-side position (most power source-side position) in a power transmission path of the gear reduction mechanism. The motor gear 7 is made of metallic material or resinous material and has a generally cylindrical shape. The motor gear 7 has a cylindrical portion that surrounds the outer circumference of the motor shaft 11.

The cylindrical portion of the motor gear 7 is supported by and fixed to an outer circumference of the motor shaft 11 by press-fitting and the like. An entire outer circumference of the cylindrical portion of the motor gear 7 is provided with gear cogs 31, which are engaged with the intermediate reduction gear 8.

The intermediate reduction gear 8, which is another component of the gear reduction mechanism, is a second gear (intermediate gear, second rotator) that is rotated by an engagement with the gear cogs 31 formed on the outer circumference of the motor gear 7. The intermediate reduction gear 8 is located between the motor gear 7 and the valve gear 9 in the power transmission path of the gear reduction mechanism. The intermediate reduction gear 8 is made of resinous material and has a generally cylindrical shape. The intermediate reduction gear 8 has a cylindrical portion that surrounds an outer circumference of the intermediate shaft 12, which is arranged in parallel with the motor shaft 11 and the valve shaft 13.

The cylindrical portion of the intermediate reduction gear 8 is fitted to an outer circumference of the intermediate shaft 12 to be rotatable with respect to the intermediate shaft 12. Further, the cylindrical portion of the intermediate reduction gear 8 has a large diameter portion in which an outer diameter of the intermediate reduction gear 8 is at the maximum, and a small diameter portion in which the outer diameter of the intermediate reduction gear 8 is smaller than in the large diameter portion.

Gear cogs (large diameter gear) 32 are formed on an entire outer circumference of the large diameter portion of the intermediate reduction gear 8, to be engaged with the gear cogs 31 that are formed on the outer circumference of the motor gear 7. Gear cogs (small diameter gear) 33 are formed also on an entire circumference of the small diameter portion of the intermediate reduction gear 8, to be engaged with gear cogs that are formed on an outer circumference of the valve gear 9.

The valve gear 9, which is still another component of the gear reduction mechanism, is a third gear (final reduction gear, third rotator) that is rotated by an engagement with the small diameter gear 33 formed on the outer circumference of the intermediate reduction gear 8. The valve gear 9 is a rotator that rotates with respect to the housing 6, and located at a most valve-side position in the power transmission mechanism. The valve gear 9 is made of resinous material and has a generally cylindrical shape. The valve gear 9 has a cylindrical portion that surrounds the outer circumference of the valve shaft 13.

A valve gear plate 34 is fixed by insert molding to an inner circumference of the cylindrical portion of the valve gear 9. The cylindrical portion of the valve gear 9 has a large diameter portion in which an outer diameter of the valve gear 9 is maximized, and a small diameter portion (second cylindrical spring guide) 35 in which the outer diameter of the valve gear 9 is smaller than in the large diameter portion. The second cylindrical spring guide 35 is arranged to be coaxial with the first cylindrical spring guide 25 of the housing 6, and to face the first cylindrical spring guide 25 to leave a predetermined clearance between the first and second cylindrical spring guides 25, 35. Outer diameters of the first and second cylindrical spring guides 25, 35 are approximately equal to each other. An outer circumference of the second cylindrical spring guide 35 guides the inner circumference of the torsional coil spring 5. Gear cogs 36 are formed on a part of an outer circumference of the large diameter portion of the valve gear 9 in an arc-like fashion, to be engaged with the small diameter gear 33 formed on the outer circumference of the small diameter portion of the intermediate reduction gear 8.

The valve gear 9 is provided with a full closure stopper portion 37 is on the outer circumference of the large diameter portion (or on the outer circumference of the small diameter portion). When the throttle valve 1 is closed to the full close angle, the full closure stopper portion 37 is mechanically stopped by a full close stopper member (not shown), which is screwed in a block-like shaped full closure stopper 39 that is an integral part of the housing 6. The full closure stopper portion 37 and the full close stopper member serve as a first restrictor that determines a bound to which the throttle valve 1 and the valve gear 9 can rotate in a valve-closing operation. As such, when the full closure stopper portion 37 of the valve gear 9 comes in contact with the full closure stopper 39 and/or the full close stopper member, the throttle valve 1 and the valve gear 9 are prevented from rotating further to a valve-closing side.

The valve gear 9 is provided with a full open stopper portion (not shown) on the outer circumference of the large diameter portion (or on the outer circumference of the small diameter portion). When the throttle valve 1 is opened to the full open angle, the full open stopper portion is mechanically stopped by a full open stopper (not shown), which is screwed in a block-like shaped full open stopper (not shown) that is an integral part of the housing 6. The full open stopper portion and the full open stopper member serve as a second restrictor that determines a bound to which the throttle valve 1 and the valve gear 9 can rotate in a valve-opening operation. As such, when the full open stopper portion of the valve gear 9 comes in contact with the full open stopper and/or the full open stopper member, the throttle valve 1 and the valve gear 9 are prevented from rotating further to the valve-opening side. A coil supporting construction of the valve gear 9 is described hereafter in detail.

In this regard, the motor shaft 11 extends straightly in its axial direction. The motor shaft 11 is rotatably installed in the gear case 26 that is defined by the housing 6 and the sensor cover 10. The intermediate shaft 12 extends straightly in its axial direction, too. One axial end portion of the intermediate shaft 12 is fixedly supported by a fitting hole provided in the outer spring guide of the housing 6, etc. by press-fitting and the like. The valve shaft 13 is rotatably and slidably supported by the shaft supporting holes in the bearing support portions 21, 22. The valve shaft 13 is a generally cylindrical metallic member that has a generally round cross-section and straightly extends from its one end portion to the other end portion. The other end portion of the valve shaft 13 penetrates through the shaft supporting hole of the bearing support portion 22 and protrudes into (exposed in) the gear case 26. The valve gear plate 34, which is fixed to an inner circumference of a cylindrical portion of the valve gear 9 by insert molding, is fixed to the other end portion of the valve shaft 13 by swaging a swaging portion that is an integral part of the other end portion of the valve shaft 13, and the like.

The motor actuator, especially the electric motor 4 is configured to be electrically controlled by the ECU. The ECU has a microcomputer that has a conventional construction including functions as a CPU, which performs control processes and calculation processes, a memory device (storage device such as a ROM, RAM, etc.) that stores a control program and other data, an input circuit (input portion), an output circuit (output portion), etc.

The ECU is configured to variably control the electric power supply to the electric motor 4 in accordance with commands generated by the computer program that is stored in the memory device when an ignition switch (not shown) of the vehicle is turned on, so as to electrically adjust the throttle opening degree.

The ECU is configured to terminate the above-mentioned motor control operation by the control program stored in the memory device, when the ignition switch is turned off. The ECU is configured so that the microcomputer receives sensor signals, which are sent from respective sensors such as a crank angle sensor, an airflow meter, coolant temperature sensor, and are converted from analog to digital by an A/D converter.

The microcomputer is connected to an accelerator sensor (not shown) that converts the degree to which the accelerator pedal of the vehicle is stepped down (quantity of accelerator operation) to an electric signal (accelerator opening degree signal) and outputs the accelerator opening degree signal to the ECU. The microcomputer is connected to the throttle angle sensor that transforms the throttle opening degree, which corresponds to the rotational angle of the throttle valve 1, to an electric signal (throttle opening degree signal), and outputs the throttle opening degree signal to the ECU. The ECU is configured to perform a feedback control of the electric power supply to the electric motor 4 so as to decrease a difference between the throttle opening degree signal sent from the throttle angle sensor and the accelerator opening degree signal sent from the accelerator sensor.

The throttle angle sensor is a non-contact rotation angle detector (throttle opening degree detector) that detects the rotational angle of the throttle valve 1. The throttle angle sensor includes split permanent magnets (not shown) that are fixed to an inner circumference of a cylindrical portion of the valve gear 9, a pair of yokes 17 that is magnetized by the magnets, a Hall IC 19 that is located on a gear-side surface of the valve gear 9, etc. The Hall IC 19 is an IC (integrated circuit) in which a Hall device, which serves as the non-contact magnetic detecting device, and an amplifier circuit are integrated. The Hall IC 19 outputs a voltage in accordance with a magnetic flux density in an interlinkage with the Hall IC 19 and passing through a magnetic detection gap formed between a pair of the yokes 17. It is also possible to use non-contact magnetic detection devices such as a Hall device alone, a magnetoresistance device, etc., instead of the Hall IC 19.

The torsional coil spring 5 is installed between the bottom wall surface of the housing 6 and a valve-side surface of the valve gear 9. The torsional coil spring 5 has a single coil spring construction in which a return spring (first spring) 41 and an opener spring (default spring, second spring) 42 are integrated. The return spring 41, which is a valve-side portion of the torsional coil spring 5, is wound in one rotational direction, and the opener spring 42, which is a gear-side portion of the torsional coil spring 5, is wound in the other rotational direction. The torsional coil spring 5 further has a U-shaped hook (intermediate spring hook) 43, a first spring end portion 44 and a second spring end portion 45. The U-shaped hook 43, which serves as an intermediate spring hook, is provided at a connection portion of the return spring 41 and the opener spring 42. The first spring end portion 44 is a valve-side axial end portion of the return spring 41 and is generally I-shaped. The second spring end portion 45 is a gear-side axial end portion of the opener spring 42 and is generally S-shaped.

The return spring 41 generates the torsional spring force (spring torque) that biases the throttle valve to a valve-closing side (from the full open angle to the intermediate angle) with respect to the valve gear 9. The return spring 41 is a torsional spring that accumulates a torsional spring force to rotate the valve gear 9 to the valve-closing side when the valve gear 9 is rotated to the valve-opening side beyond the intermediate angle. The return spring 41 has a first cylindrical coil portion that is arranged in a cylindrical spring installing chamber 46 that is defined by the first cylindrical spring guide 25 of the bearing support portion 22 of the throttle body 2, the second cylindrical spring guide 35 of the valve gear 9, and the inner circumference of the outer spring guide of the housing 6.

The first cylindrical coil portion, which is wound about the axial direction of the valve shaft 13, is arranged to surround circumferences of the first cylindrical spring guide 25 of the housing 6 and the second cylindrical spring guide 35 of the valve gear 9 in a spiral fashion. The valve-side end portion of the first cylindrical coil portion is the first spring end portion 44 that is bent into an approximately right angle to extend straightly in a radial direction of the torsional coil spring 5. The first spring end portion 44 is regularly supported by a first spring support surface 61, which is described hereafter.

The opener spring 42 generates the torsional spring force (spring torque) that biases the throttle valve 1 to the valve-opening side (from the full close angle to the intermediate angle) with respect to the valve gear 9. The opener spring 42 is a torsional spring that accumulates a torsional spring force to rotate the valve gear 9 to the valve-opening side when the valve gear 9 is rotated to the valve-closing side beyond the intermediate angle. The opener spring 42 is wound in a rotational winding direction opposite from that of the return spring 41, by a winding number smaller than that of the return spring 41 in a spiral fashion. That is, an axial length of the opener spring 42 is shorter than that of the return spring 41. The opener spring 42 is generally coaxial with the return spring 41, and a coil pitch of the opener spring 42 is approximately equal to that of the return spring 41. A diameter of a spring wire of the opener spring 42 is approximately equal to that of the return spring 41, and an outer diameter of the opener spring 42 is approximately equal to that of the return spring 41.

The opener spring 42 has a second cylindrical coil portion that is arranged in the cylindrical spring installing chamber 46 that is defined by the first cylindrical spring guide 25 of the bearing support portion 22 of the throttle body 2, the second cylindrical spring guide 35 of the valve gear 9, and the inner circumference of the outer spring guide of the housing 6.

The second cylindrical coil portion, which is wound about the axial direction of the valve shaft 13, is arranged to surround the circumference of the second cylindrical spring guide 35 of the valve gear 9 in a spiral fashion. The gear-side end portion of the second cylindrical coil portion is the second coil end portion 45 that is bent into an approximately right angle to extend in the radial direction of the torsional coil spring 5 and further bent in a generally S-shaped fashion to overlie the outer circumference of the second cylindrical coil portion of the torsional coil spring 5. The second spring end portion 45 is regularly supported by a second spring support surface 52, which is described hereafter.

The connection portion of a gear-side axial end of the first cylindrical portion of the return spring 41 and a valve-side axial end of the second cylindrical portion of the opener spring 42 is provided with the U-shaped hook 43. The U-shaped hook 43 is supported by the intermediate stopper member 29 screwed in the intermediate angle stopper 27 of the housing 6, when the electric power supply to the electric motor 4 is stopped or interrupted by any cause. The U-shaped hook 43 is formed by bending the connection portion of the return spring 41 and the opener spring 42 in a generally U-shaped fashion. The U-shaped hook 43 goes into and comes out of an engagement with the second spring end support 52, which is described hereafter, in accordance with a rotational angle of the throttle valve 1 and the valve gear 9.

The U-shaped hook 43, which is at the valve-side end of the second cylindrical coil portion of the opener spring 42, serves as a first loading portion that generates a torsional spring force that biases the throttle valve 1 to the valve-closing side with respect to the valve gear 9. The second spring end portion 45, which is at the gear-side end portion of the second cylindrical coil portion of the opener spring 42, serves as a second loading portion that generates a spring force biasing the throttle valve 1 in the valve-opening direction with respect to the valve gear 9.

A coil spring supporting construction of the throttle control apparatus according to the present embodiment is described in detail in the following, referring to FIGS. 1-3.

A first spring end support 51 that supports the first spring end portion 44 of the return spring 41 is formed integrally with the outer wall surface of the cylindrical portion 3 of the throttle body 2, that is, the bottom wall surface of the housing 6. The first spring end support 51 is provided with a first engaging portion (housing hook, not shown) that has a generally depressed shape, a generally protruding shape, etc., to regularly support the first spring end portion 44 of the return spring 41. The first spring end support 51 is provided on the bottom wall surface of the housing 6. The first spring end support 51 is a seat surface that receives the torsional spring force of the return spring 41.

The large diameter portion of the valve gear 9 is integrally provided with the second spring end support 52 that has one body to support both the U-shaped hook 43 of the torsional coil spring 5 and the second spring end portion 45 of the opener spring 42. The second spring end support 52 serves as the spring force receiving portion according to the present invention. The second spring end support 52 has a generally F-shape that protrudes from the large diameter portion of the valve gear 9 toward the cylindrical portion of the throttle body 2 to overlie the outer circumference of the torsional coil spring 5.

The large diameter portion of the valve gear 9 is integrally provided with a generally cylindrical coil cover portion 54 that forms the annular space 53 to cover the outer circumference of the gear-side end portion (right end portion in FIGS. 1, 3) of the second cylindrical coil portion of the opener spring 42. The coil cover portion 54 is provided with a dent portion (notch) 55 at an angle close to a base end of the second spring end support 52, through which a second coil end of the opener spring 42 is taken out of the space 53 in the radial direction of the torsional coil spring 5 or in a direction inclined by a predetermined angle (45 degrees, for example) with respect to the axial direction of the second cylindrical coil portion in a straight or generally S-shaped fashion.

The second spring end support 52 of the valve gear 9 is provided with a generally C-shaped support 56 at its axial end opposite from the coil cover portion 54, which intersects a rotation path of the U-shaped hook 43 of the torsional coil spring 5. The C-shaped support 56 is provided with the first spring support surface 61 and the second spring support surface 62 on its both sides in a circumferential direction of the valve gear 9. That is, the first and second spring support surfaces 61, 62 are arranged in a back-to-back fashion on one rotational path coaxial to a rotation axis of the valve gear 9.

The first spring support surface 61 supports the U-shaped hook 43 of the torsional coil spring 5 to receive the torsional spring force of the torsional coil spring 5. The second spring support surface 62 is a right back of the seat surface of the first spring support surface 61 of the C-shaped support 56, that is, a surface opposite from the seat surface of the first spring support surface 61. The second spring support surface 62 supports the S-shaped second spring end portion 45 of the opener spring 42 to receive the torsional spring force of the torsional coil spring 5. It is possible to provide a guard on the seat surface of the second spring support surface 62 to prevent the S-shaped second spring end portion 45 of the opener spring 42 from moving outward in the radial direction of the torsional coil spring 5 out of the seat surface of the second spring support surface 62 due to a counteraction of an extension of shrinkage of the outer diameter of the opener spring 42 that is extended or shrunk by a torsion of the torsional coil spring 5 in the valve-opening operation or in the valve-closing operation of the throttle valve 1.

The C-shaped support 56 has a pair of anti-slip guides 63, 64 that protrudes from both sides of the first spring support surface 61 in the axial direction of the valve gear 9 to one rotational side about the rotation center of the valve gear 9, i.e., to the valve-opening side. The anti-slip guides 63, 64 prevent the U-shaped hook 43 from moving beyond the anti-slip guides 63, 64 in the axial direction of the torsional coil spring 5 (in a horizontal direction in FIGS. 1, 2). A space defined by the seat surface of the first spring support surface 61 and inner surfaces of the anti-slip guides 63, 64 serve as an engaging portion, into which the U-shaped hook 43 of the torsional coil spring 5 goes and out of which the U-shaped hook 43 comes.

[Actions of Throttle Control Apparatus]

Figure 4A:
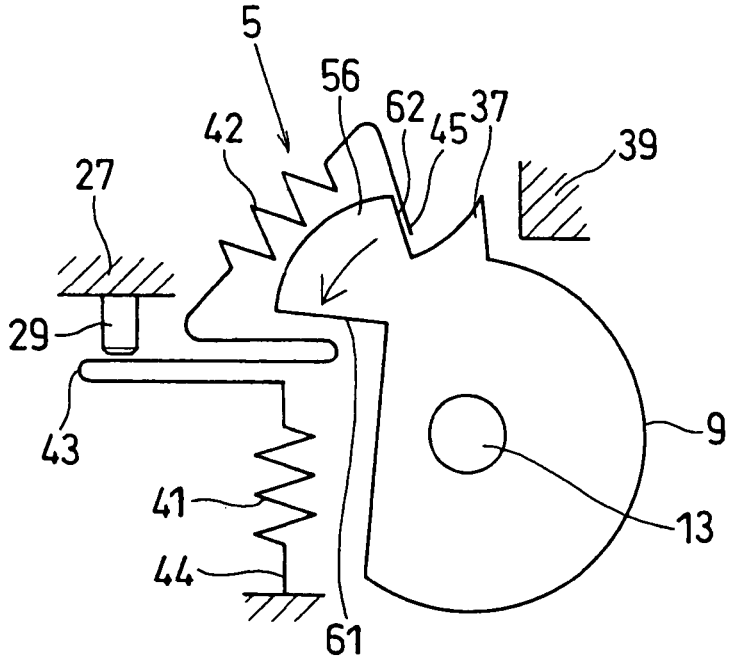
FIGS. 4A, 4B are schematic diagrams showing spring load acting on the valve gear of the throttle control apparatus according to the embodiment.
Figure 4B:
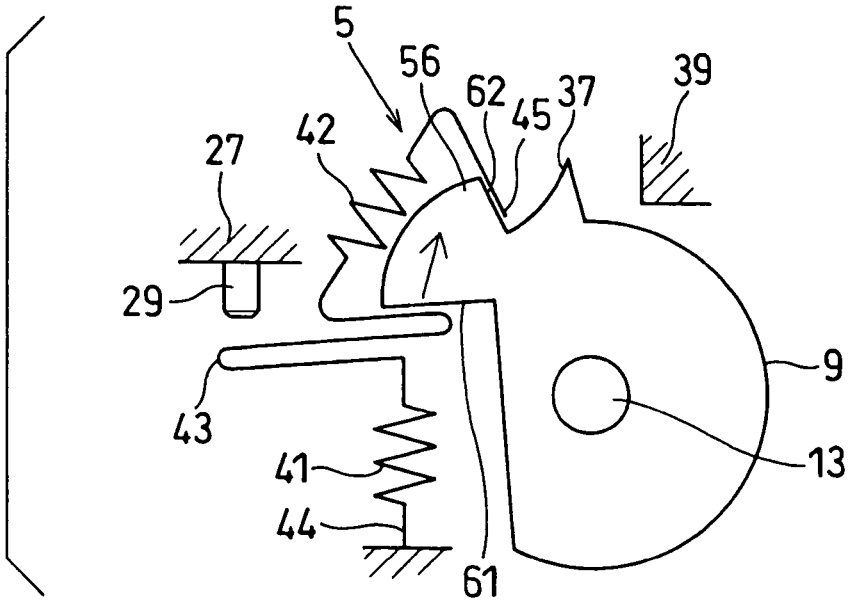

Actions of the air intake control apparatus according to the present embodiment is described in the following, referring to FIGS. 1-4B. FIG. 4A schematically shows the spring force acting on the C-shaped support 56 of the valve gear 9 when the throttle valve 1 is actuated to the valve-closing side beyond the intermediate angle. FIG. 4B schematically shows the spring force acting on the C-shaped support 56 of the valve gear 9 when the throttle valve 1 is actuated to the valve-opening side beyond the intermediate angle.

When the ignition switch is turned on, the ECU calculates a target control value of the throttle valve 1 (target throttle opening degree) in accordance with the accelerator opening degree (quantity of accelerator operation), which is the degree to which the accelerator pedal is stepped down, which is detected by the accelerator sensor. Then, the ECU performs the feedback control of the electric power supply to the electric motor 4 to generally equalize the throttle opening degree that is detected by the throttle angle sensor to the target throttle opening degree that is determined in accordance with the accelerator opening degree.

When the electric motor 4 is supplied with electric power, the motor shaft 11 of the electric motor 4 rotates. Then, the motor gear 7 rotates about the center axis of the motor shaft 11 in accordance with the rotation of the motor shaft 11, and a driving torque of the electric motor 4 is transmitted from the gear cogs 31 of the motor gear 7 to the large diameter gear 32 of the intermediate reduction gear 8. Further, the intermediate reduction gear 8 rotates about the center axis of the intermediate shaft 12 in accordance with the rotation of the intermediate reduction gear 8, and the driving torque is transmitted from the small diameter gear 33 of the intermediate reduction gear 8 to the gear cogs 36 of the valve gear 9. Then, the valve shaft 13, which is fixed to the valve gear 9, rotates about the center axis of the valve shaft 13 by a certain rotation angle in accordance with the rotation of the valve gear 9. As such, the throttle valve 1 is actuated from the full close angle (or from the intermediate angle) toward the full open angle.

In a case that the throttle valve 1 is at an angle closer to the full close angle than the intermediate angle is, when the throttle valve 1 and the valve gear 9 are actuated toward the full open angle, the U-shaped hook 43 of the torsional coil spring 5, at which the return spring 41 and the opener spring 42 are connected to each other, is in contact and engaged with the intermediate stopper member 29, which is screwed in the intermediate angle stopper 27 of the housing 6. Thus, as shown in FIG. 4A, the U-shaped hook 43 of the torsional coil spring 5 is slightly apart from the seat surface of first spring support surface 61 of the C-shaped support 56, which is provided in a leading end portion of the second spring end support 52 of the valve gear 9 to the valve-closing side. Then, the C-shaped support 56 of the valve gear 9 is not subjected to the biasing force (spring force) of the return spring 41 of the C-shaped support 56, and is subjected to the biasing force (spring force) of only the opener spring 42. Accordingly, when the throttle valve 1 is at an angle closer to the full close angle than the intermediate angle is, the throttle valve is actuated from the full close angle to the target throttle opening degree by the driving torque of the electric motor 4 and the spring force of the opener spring 42.

In a case that the throttle valve 1 is at an angle closer to the full open angle than the intermediate angle is, when the throttle valve 1 and the valve gear 9 are actuated toward the full open angle, the U-shaped hook 43 of the torsional coil spring 5 is pushed on the seat surface of the first spring support surface 61 of the valve gear 9 as shown in FIG. 4B. Thus, the seat surface of the first spring support surface 61 of the C-shaped support 56 is subjected to the torsional spring force (torque) of the U-shaped hook 43 of the torsional coil spring 5. In this regard, the second spring end portion 45 of the opener spring 42 regularly abuts on the seat surface of the second spring support surface 62, which is the back side of the seat surface of the first spring support surface 61 of the C-shaped support 56.

That is, when the throttle valve 1 is at the angle closer to the full open angle than the intermediate angle is, the U-shaped hook 43 of torsional coil spring 5 applies the spring force of the torsional coil spring 5 on the first spring support surface 61 of the C-shaped support 56 of the valve gear 9 in one direction, and the second spring end portion 45 of the opener spring 42 applies the spring force of the torsional coil spring 5 on the second spring support surface 62 of the C-shaped support 56 of the valve gear 9 in the other direction. Then, the spring force of the opener spring 42, and the spring force of the torsional coil spring 5 applied by the U-shaped hook 43, which are applied on both the first and second surfaces 61, 62 of the C-shaped support 56, cancel each other. Thus, when the throttle valve 1 is at the angle closer to the full open angle than the intermediate angle is, the C-shaped support 56 of the valve gear 9 is subjected to the torsional spring force (torque) of the return spring 41. Accordingly, the driving force of the electric motor 4 actuates the throttle valve 1 from the intermediate angle to the target throttle opening degree, against the biasing force of the return spring 41.

As such, the throttle bore 14 of the cylindrical portion 3 of the throttle body 2 is opened by a predetermined throttle opening degree, so that the intake air is sucked into the combustion chambers of the cylinders of the engine by a quantity corresponding to the throttle opening degree, and the number of revolution of the engine is changed to a degree corresponding to the accelerator opening degree.

In this regard, when the driver releases the accelerator pedal to let the accelerator opening degree be 0%, the ECU controls the electric power supply to the electric motor 4 to bring the full closure stopper portion 37 of the valve gear 9 in contact with the full close stopper member that is screwed in the full closure stopper 39 of the housing 6. Specifically, the ECU reverses a direction of the driving current supplied to the electric motor 4.

When the full closure stopper portion 37 of the valve gear 9 comes in contact with the full closure stopper 39 and/or the full close stopper member to prevent the valve gear 9 from rotating further to the valve-closing side, the throttle valve 1 is kept at the full close angle in the throttle bore 14 of the cylindrical portion 3 of the throttle body 2. Thus, the quantity of the intake air, which is sucked through the throttle bore 14 of the cylindrical portion 3 of the throttle body 2 into the combustion chambers of the cylinders of the engine, is minimized, and the number of revolution of the engine becomes to an idling number of revolution.

In the present embodiment, the throttle valve 1 is arranged to be slightly inclined to the valve-opening side with respect to a normal to the axial direction of the throttle bore 14 (intake airflow direction) by a predetermined rotational angle, when the throttle valve 1 is fully closed. The ECU controls the electric power supply to the electric motor 4 to be continued while the throttle valve 1 is kept in the full close angle.

When the electric power supply to the electric motor 4 is interrupted by any cause during an operation of the engine, the spring forces of the return spring 41 and the opener spring 42 bring and keep the U-shaped hook 43 of the torsional coil spring 5 in contact with the intermediate stopper member 29 that is screwed in the intermediate angle stopper 27 of the housing 6, in a state that the C-shaped support 56 of the valve gear 9 is caught between the U-shaped hook 43 of the torsional coil spring 5 and the second spring end portion 45 of the opener spring 42. As such, the valve gear 9 is supported securely at the intermediate angle between the full close angle and the full open angle, so that the throttle valve 1 opens the throttle bore 14 in the cylindrical portion 3 of the throttle body 2 by the predetermined intermediate opening degree. In this manner, the intake air is introduced through the throttle bore 14 in the cylindrical portion 3 of the throttle body 2 into the combustion chambers of the cylinders of the engine. Accordingly, even when the electric power supply to the electric motor 4 is interrupted by any cause, it is possible to perform a fallback travel (limp home travel) of the vehicle.

[Features and Advantages of Throttle Control Apparatus]

As described above, the air intake control apparatus (throttle control apparatus) according to the present embodiment has the torsional coil spring 5 in which the return spring 41 and the opener spring 42 are integrated. The return spring 41 exerts the spring force on the first spring support surface 61 of the C-shaped support 56, which is provided on the second spring end support 52 of the valve gear 9, to bias the throttle valve 1 toward the full close angle. The opener spring 42 exerts the spring force on the second spring support surface 62 of the C-shaped support 56 to bias the throttle valve 1 toward the full open angle. The return spring 41 includes the first cylindrical coil portion that surrounds the circumferences of the first cylindrical spring guide 25 of the housing 6 and the second cylindrical spring guide 35 of the valve gear 9 in a spiral fashion. The opener spring 42 includes the second cylindrical coil portion that surrounds the circumference of the second cylindrical spring guide 35 of the valve gear 9 in a spiral fashion.

The torsional coil spring 5 has a single coil spring construction in which the gear-side axial end of the first cylindrical coil portion of the return spring 41 is connected to the valve-side axial end of the second cylindrical coil portion of the opener spring 42, and in which the first cylindrical portion of the return spring 41 is wound in the one rotational direction, and the second cylindrical portion of the opener spring 42 is wound in the other rotational direction. The torsional coil spring 5 has the U-shaped hook 43, the first spring end portion 44 and the second spring end portion 45. The U-shaped hook 43 is formed at the connection portion of the gear-side axial end of the first cylindrical coil portion of the return spring 41 and the valve-side axial end of the second cylindrical coil portion of the opener spring 42. The U-shaped hook 43 is formed by bending the connection in a generally U-shaped fashion. The first spring end portion 44 is provided on the valve-side axial end of the first cylindrical coil portion of the return spring 41, and supported by the seat surface of the first spring end support 51 of the housing 6. The second spring end portion 45 is provided on the gear-side axial end of the second cylindrical coil portion of the opener spring 42, and supported by the second spring support surface 62 of the C-shaped support of the valve gear 9.

In the air intake control apparatus according to the present embodiment, the valve-side tip portion of the second spring end support 52 of the valve gear 9, which is fixed to the gear-side axial end portion of the valve shaft 13, is provided with the C-shaped support 56. The C-shaped support 56 supports the U-shaped hook 43 to receive the torsional spring force of the torsional coil spring 5, which is exerted in the one rotational direction, and supports the second spring end portion 45 to receive the torsional spring force of the opener spring 42, which is exerted in the other rotational direction. The C-shaped support 56 has the first spring support surface 61, which supports the U-shaped hook 43 to receive the torsional spring force of the torsional coil spring 5, and the second spring support surface 62, which supports the second spring end portion 45 to receive the torsional spring force of the opener spring 42. The first and second spring support surfaces 61, 62 are arranged back to back on one rotation path about the center axis of the valve gear 9.

Accordingly, the first and second spring support surfaces 61, 62 are integrated in one C-shaped support 56, which is provided in the valve-side tip portion of the second spring end support 52 of the valve gear 9. That is, two of the first and second spring support surfaces 61, 62 are provided in one location. As such, a body of the valve gear 9 is downsized, with respect to the valve gear 109 in the conventional throttle control apparatus (refer to FIGS. 5-9B), in which the second spring end support 152 for supporting the second spring end portion 145 to receive the spring force of the opener spring 142, and the C-shaped support 156 for supporting the U-shaped hook 43 to receive the spring force of the torsional coil spring 105, are arranged separately from each other. Accordingly, it is possible to decrease material cost and manufacturing cost of the valve gear 9.

In the throttle control apparatus disclosed in Patent document 1, when the throttle valve 101 is at an angle between the full open angle and the intermediate angle, torsional spring forces (torques) of both the return spring 141 and the opener spring 142 exerts on the C-shaped support 156 of the valve gear 109. Therefore, the C-shaped support 156 must be provided with a relatively large rigidity. In this regard, in the air intake control apparatus according to the present embodiment, the valve gear 9 is provided with the C-shaped support 56 that supports both the U-shaped hook 43 and the second spring end portion 45, to receive both the torsional spring force of the return spring 41 in the one rotational direction and the torsional spring force of the opener spring 42 in the other rotational direction. As such, when the throttle valve 1 is at an angle between the full open angle and the intermediate angle, the torsional spring forces in the one and the other rotational directions, which are exerted by two hooks of the opener spring 42, i.e., the U-shaped hook 43 and the second spring end portion 45, cancel each other. As a result, the C-shaped support 56 is subjected to the torsional spring force (torque) of only the return spring 41. Accordingly, the C-shaped support 56 is subjected to a relatively small stress, and it is possible to decrease the rigidity of the C-shaped support 56.

When the throttle valve 1 is at an angle between the full close angle and the intermediate angle, the C-shaped support 56 is subjected to the torsional spring force (torque) of only the opener spring 42 in the other rotational direction, which is opposite from the one rotational direction of the torsional spring force (torque) of the return spring 41. In this case, a magnitude of the torsional spring force of the opener spring 42 is equivalent to that of the torsional spring force of the return spring 41, so that it is not necessary to raise the rigidity of the C-shaped support 56.

MODIFIED EMBODIMENTS

In the above-described embodiment, the throttle control apparatus according to the present invention is applied to the air intake control apparatus for regulating the quantity of intake air that is sucked into combustion chambers of internal combustion engine. The throttle control apparatus according to the present invention can also be applied, for example, to an idling rotational speed control valve for regulating a quantity of intake air that detours a throttle valve, an exhaust gas control valve for regulating a quantity of exhaust gas that is emitted out of combustion chambers of an internal combustion engine, and an exhaust gas recirculation valve (EGR valve) for regulating a quantity of exhaust gas that is recirculated from an exhaust passage to an intake passage of an internal combustion engine. The throttle control apparatus according to the present invention can also be applied to an intake airflow control valve for generating swirl of intake air to promote combustion of air-fuel mixture in combustion chambers of an internal combustion engine.

The return spring (first spring) 41 and the opener spring (second spring) 42 of the torsional coil spring 5 can be a regular pitch coil, which has an approximately regular outer circumference and a regular winding pitch along its length, an irregular pitch coil, which has an approximately regular outer circumference and an irregular winding pitch along its length, or a nonlinear spring (e.g. a hourglass-shaped spring, a straw bag-shaped spring, a conically trapezoidal spring), which has an irregular outer diameter along its length. The torsional coil spring 5 may have a configuration in which the center axis of the opener spring 42 is previously decentered (offset) in a direction opposite to that of rotational deformation occurring when the coil return spring 41 is mounted on the housing 6 and the valve gear 9, so as to prevent abrasion of the first and second cylindrical spring guides 25, 35.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. A throttle control apparatus comprising:

a housing that defines a throttle duct therein;

a rotator that has a rotation axis and a throttle valve fixed to the rotation axis, the rotation axis being rotatably supported by the housing so that the throttle valve rotates about the rotation axis between a full open angle at which the throttle valve fully opens the throttle duct and a full close angle at which the throttle valve fully closes the throttle duct;

a torsional coil spring that is arranged to be generally coaxial with the rotation axis and is associated with the housing and the rotator to bias the throttle valve to a predetermined intermediate angle between the full open angle and the full close angle; and an actuator that rotationally actuates the rotator between the full open angle and the full close angle against a biasing force of the torsional coil spring, wherein the torsional coil spring has a first loading portion that applies a biasing force to the rotator to bias the throttle valve from the full open angle toward the intermediate angle, and a second loading portion that applies a biasing force to the rotator to bias the throttle valve from the full close angle to the intermediate angle, the rotator is provided with a spring force receiving portion that receives both the biasing forces applied by the first and second loading portions so that the first and second loading portions sandwich the spring force receiving portion therebetween, the second loading portion is one end portion of the torsional coil spring and is bent into a generally S-shape, an end part of the S-shape second loading portion contacts the spring force receiving portion while a remainder of the S-shape second loading portion is spaced from the spring force receiving portion, and the first loading portion contacts the spring force receiving portion so as to oppose said end part of the second loading portion in a circumferential direction.

2. The throttle control apparatus according to claim 1, wherein the spring support portion has a first spring seat and a second spring seat back to back, the first spring seat is associated with the first loading portion, and the second spring seat is associated with the second loading portion.

3. The throttle control apparatus according to claim 2, wherein a point of action at which the first loading portion applies the biasing force to the first spring seat, and a point of action at which the second loading portion applies the biasing force to the second spring gear are arranged generally on one circular path that is coaxial with the rotation axis.

4. The throttle control apparatus according to claim 1, wherein the first loading portion is engaged with the spring force receiving portion when an angle of the throttle valve is between the intermediate angle and the full open angle and disengaged from the spring force receiving portion when the angle of the throttle valve is not between the intermediate angle and the full open angle.

5. The throttle control apparatus according to claim 4, wherein the first spring has a pair of guides between which the first loading portion is arranged so that the guides prevent the first loading portion from moving beyond the anti-slip guides when the first loading portion is disengaged from the spring force receiving portion.

6. The throttle control apparatus according to claim 1, wherein the second loading portion regularly applies the biasing force on the spring force receiving portion.

7. The throttle control apparatus according to claim 1, wherein the torsional coil spring includes:

a first spring that generates the biasing force to bias the rotator from the full open angle to the intermediate angle; and a second spring that generates the biasing force to bias the rotator from the full close angle to the intermediate angle.

8. The throttle control apparatus according to claim 7, wherein the first spring and the second spring of the torsional coil spring are integrated in one body.

9. The throttle control apparatus according to claim 8, wherein the first loading portion of the torsional coil spring is an intermediate spring hook that is located in the a connection portion of the first spring and the second spring has a first loading portion.

10. The throttle control apparatus according to claim 9, wherein the first loading portion is generally U-shaped by bending a spring wire of the torsional coil spring.

11. The throttle control apparatus according to claim 8, wherein second loading portion of the torsional coil spring is located in a gear-side end portion of the second spring, which is opposite from the intermediate spring hook.

12. The throttle control apparatus according to claim 11, wherein the second loading portion is curved by bending a spring wire of the torsional coil spring so that an outer side of a curve of the second loading portion is in contact at a point with the spring force receiving portion.

13. The throttle control apparatus according to claim 7, wherein:

the housing has a first cylindrical spring guide that coaxially surrounds the rotation axis of the rotator;

the rotator has a second cylindrical spring guide that is arranged to be generally coaxial with the first cylindrical spring guide to leave a predetermined clearance between the first and second cylindrical spring guide; and inner circumferences of the first and second springs are guided by the first and second cylindrical spring guides.

14. The throttle control apparatus according to claim 1, wherein:

the actuator includes a power generator that generates a driving force to actuate the rotator and a reduction gear mechanism that includes a plurality of gears that transmit the driving force generated by power generator to the rotator; and the rotator is integrated with one of the plurality of gears of the gear reduction mechanism.

15. The throttle control apparatus according to claim 1, wherein the throttle duct forms a part of an air intake passage of an internal combustion engine so that the throttle valve adjusts a quantity of an intake air supplied to a combustion chamber of the internal combustion engine.

16. The throttle control apparatus according to claim 1, wherein:

the other end portion of the torsional coil spring is supported by the housing; and the first loading portion is an intermediate portion of the torsional coil spring between the second loading portion and the other end portion of the torsional coil spring.

17. The throttle control apparatus according to claim 16, wherein the first loading portion is bent into a U-shape.

18. A throttle control apparatus comprising:

a housing that defines a throttle duct therein;

a rotator that has a rotation axis and a throttle valve fixed to the rotation axis, the rotation axis being rotatably supported by the housing so that the throttle valve rotates about the rotation axis between a full open angle at which the throttle valve fully opens the throttle duct and a full close angle at which the throttle valve fully closes the throttle duct;

a torsional coil spring that is arranged to be generally coaxial with the rotation axis and is associated with the housing and the rotator to bias the throttle valve to a predetermined intermediate angle between the full open angle and the full close angle; and an actuator that rotationally actuates the rotator between the full open angle and the full close angle against a biasing force of the torsional coil spring, wherein the torsional coil spring has a first loading portion that applies a first biasing force to the rotator to bias the throttle valve from the full open angle toward the intermediate angle, and a second loading portion that applies a second biasing force to the rotator to bias the throttle valve from the full close angle to the intermediate angle, the rotator is provided with a spring force receiving portion that is fixed to the rotator to rotate integrally with the rotator, and the first loading portion, the spring force receiving portion and the second loading portion are placed one after another in this order along an imaginary circle that extends about the rotation axis, so that both of a point of application of the first biasing force and a point of application of the second biasing force are on the imaginary circle.

* * * * *